US005588896A

United States Patent [19]

Goodman

[11] Patent Number: 5,588,896

[45] Date of Patent: Dec. 31, 1996

[54] TOY BALLOON INFLATION AND EJECTION DEVICE

[76] Inventor: Gregory L. Goodman, 303 E. 37th St. Apt. 6B, New York, N.Y. 10016

[21] Appl. No.: 519,545

[22] Filed: Aug. 25, 1995

[51] Int. Cl.[6] ..... A63H 27/26; A63H 3/06

[52] U.S. Cl. ..... 446/187; 124/57; 446/220; 446/225

[58] Field of Search ..... 446/176, 186, 446/187, 211, 212, 220, 221, 222, 224, 225, 429, 430; 124/57, 62, 41.1

[56] References Cited

U.S. PATENT DOCUMENTS

| | | | |
|---|---|---|---|
| 3,025,634 | 3/1962 | Barricks | 124/57 X |
| 3,563,676 | 2/1971 | Coovert et al. | 446/220 X |
| 3,698,374 | 10/1972 | Casper . | |
| 4,134,228 | 1/1979 | Ortiz | 446/430 X |
| 4,248,008 | 2/1981 | Pitkanen | 446/224 X |

FOREIGN PATENT DOCUMENTS

| | | | |
|---|---|---|---|
| 2379302 | 10/1978 | France | 446/187 |
| 2115346 | 10/1971 | Germany | 446/186 |

*Primary Examiner*—D. Neal Muir

[57] ABSTRACT

A rocket launching pad-like device for inflating and ejecting toy balloons that permits a balloon to be mounted directly on the device, permits the balloon to be inflated while mounted on the device, shields a child's face and eyes during inflation of the balloon, and forcibly ejects the inflated balloon from the device on demand. An efficient ramming surface enables use of the device with balloons of a range of sizes. A docking station may be used to group a plurality of inflation and ejection devices to provide a multiple balloon launching toy.

14 Claims, 4 Drawing Sheets

TOY BALLOON INFLATION AND EJECTION DEVICE

FIELD OF THE INVENTION

This invention is a toy that secures a standard latex balloon in place, assists in safely inflating the balloon, and then forcibly but smoothly ejects the inflated balloon on demand to fly about in the air.

BACKGROUND OF THE INVENTION

Children enjoy the act of inflating a latex balloon and then letting it go to fly about in the air. They also enjoy playing with toys that allow them to actively exert control over a physical phenomenon, such as may be the case with toys for launching inflated balloons to fly in the air. In addition to being fun, toys for children should also be safe to use and easy to operate.

Toy devices are known that are designed to permit a latex balloon to be affixed to the device, inflated by blowing through an air tube in the device, and then released to fly in the air by pulling a trigger. Examples include U.S. Pat. No. 3,025,634 to Barricks (1962), U.S. Pat. No. 4,134,228 to Ortiz (1979), and U.S. Pat. No. 4,248,008 to Pitkanen (1981). Alternatively, U.S. Pat. No. 3,698,374 to Casper (1972) discloses a device that requires the balloon to first be inflated before being affixed to the device prior to its release by pulling a trigger.

In general, the act of inflating a balloon can be hazardous for a child since the balloon can burst in close proximity to the child's face and eyes. None of the prior art patents noted above disclose any parts intended to shield the child's face and eyes while the child blows air into the balloon.

An additional risk exists if a hard object is attached to the balloon and carried along with the balloon in flight. Both the Barricks and Ortiz devices require that a rigid tubular insert first be affixed in the neck of the balloon. The insert is then attached to a gun-like launching mechanism. Upon inflation and release, the insert remains in the neck of the balloon and is carried along in flight, thus creating a risk of injury to the face or eyes of anyone nearby. Furthermore, inserts that are small enough to fit into the neck of an average sized balloon may also be small enough for a child to accidentally swallow.

In addition to being safe, toys should also be easy to operate since children do not generally have high degrees of manual dexterity. The device disclosed in the Casper patent requires the user to first inflate the balloon, then hold the neck of the inflated balloon closed while squeezing a lever on the device which opens spring actuated jaws. The user then holds the neck of the balloon in the middle of the jaws and releases the lever to allow the jaws to clamp down on the neck of the balloon. Subsequent squeezing of the lever in a trigger-like fashion causes the jaws to open once again, which, in turn, allows the inflated balloon to escape and fly away. Children can be expected to find the task of holding an inflated balloon in position while letting go of a lever to close the jaws cumbersome—made more so by the fact that "un-squeezing something in order to close it" is a concept that does not come naturally to many children. Moreover, they risk getting their fingers pinched in the spring actuated jaws.

In the Pitkanen device, the inflated balloon is also permitted to escape and fly away upon squeezing a trigger. Although the device first imparts a spin to the inflated balloon by way of a complicated mechanism prior to its release, the actual release is effected by the removal of a retaining element referred to as a locking sleeve. In operation, a user affixes the neck of a balloon over the end of a cylindrical nozzle, and inserts the balloon neck bead into a peripheral groove in the nozzle. The nozzle is then drawn into the locking sleeve such that the peripheral groove and balloon neck bead are covered by the closely fitting sleeve. After the balloon has been inflated, triggering the device advances the nozzle out of the sleeve, which is intended to permit the air pressure of the inflated balloon to cause it to fly off the nozzle. In order for this device to operate effectively, however, when an uninflated balloon is first affixed on the nozzle it would be necessary either for the neck of the balloon to frictionally adhere to the nozzle, and/or for the bead to be frictionally held in the groove. Otherwise, the balloon would not remain in position as the nozzle is drawn into the sleeve. This substantially limits the range of sizes of balloon that may be used with the device. If a balloon has either a neck much smaller than the nozzle, or a bead much larger than the groove, then a significant amount of frictional adhesion would be established when the balloon is affixed on the nozzle or the bead forced into the groove. Since latex is naturally resistant to sliding, the amount of force needed to overcome even a small amount of frictional adhesion could easily exceed the force of air pressure exerted by the inflated balloon. Since the device lacks any parts or mechanism intended to physically push the bead out of the groove, or the neck off of the nozzle, the balloon would remain on the nozzle even though it was no longer restrained by the locking sleeve.

Another drawback to the Pitkanen device, which also applies to the Barricks and Ortiz devices, is the high number of moving parts. All three have numerous parts, which significantly contributes to the cost of manufacturing and assembly.

The Casper device, on the other hand, has few moving parts, and would likely be inexpensive to manufacture and assemble. However, the Casper device does not provide the ease of being able to mount the balloon to the device prior to inflation.

The devices disclosed in the Barricks, Ortiz, Pitkanen, and Casper patents all have the following deficiencies:

(a) None of the devices provide protection for a child's face and eyes while the child is inflating the balloon;

(b) None of the devices actively force an inflated balloon to disengage from the device in order to commence its flight;

(c) All four of the devices are designed to look and operate like guns. In today's society, many parents are opposed to their children playing with toy guns, particularly in light of recent tragedies where children were harmed because toy guns were mistaken for the real thing; and, (d) The Barricks, Ortiz, and Pitkanen devices provide an air tube for blowing air into a mounted balloon, and a release mechanism of one form or another, but have numerous moving parts that would be costly to manufacture and assemble. The Casper device has a release mechanism and few moving parts, and would be inexpensive to manufacture and assemble, but does not include an air tube which would permit a balloon to be mounted prior to inflation. Therefore, none of the prior art patents disclose a device that has few moving parts and would be inexpensive to manufacture and assemble that also includes a release mechanism and permits mounting of a balloon for inflation through an air tube.

SUMMARY OF THE INVENTION

The present invention provides a toy balloon inflation and ejection mechanism that permits a balloon to be mounted directly on the mechanism, permits the balloon to be inflated while mounted on the mechanism, shields a child's face and eyes during inflation, and forcibly ejects the inflated balloon from the mechanism on demand, yet contains only four easy-to-produce parts. These features eliminate several problems with the prior art. That is, the inflation and ejection mechanism of the present invention incorporates a barrier that protects against balloon fragments in the event a balloon bursts during inflation. Also, a balloon may be attached easily without the need for a separate part that has to be inserted into the neck of the balloon, or that would be carried in flight. There are no small, loose parts that a child might accidentally swallow; the mechanism is simple to operate and safe for little fingers; and the mechanism permits the use of balloons of a range of sizes. Moreover, the present invention can be made in the form of a rocket launching pad, rather than having the appearance of a gun, and can be manufactured and assembled simply and inexpensively.

The features and aspects noted above are accomplished by providing a support surface to which the bead of a balloon will frictionally adhere when stretched open and pulled over, an air tube for inflating the balloon, and a ramming surface for forcibly separating the bead from the support surface.

More particularly, the present toy balloon inflation and ejection mechanism is based on a hollow elongated shaft contained within a close-fitting sleeve. The shaft and the sleeve are able to slide in relation to one another such that one end of the shaft may alternately protrude from an end of the sleeve a certain distance, or be retracted into the sleeve by telescoping the shaft and the sleeve. The exterior surface of the shaft has indentations extending longitudinally along a portion of the length of the shaft, starting at the end of the shaft that is able to protrude from the sleeve. The interior surface of the sleeve has projections extending longitudinally along a portion of the length of the sleeve, starting at the end from which the shaft is able to protrude. The projections on the sleeve are aligned with, and inversely match, the indentations in the shaft.

When the end of the shaft is protruding from the sleeve, the bead of a balloon may be mounted on the shaft by stretching the bead open and pulling the bead over that protruding end of the shaft. Any balloon having a bead smaller in diameter than the shaft will frictionally adhere to the shaft. Since the shaft is hollow, air may be blown into the shaft at the end opposite to the end where the balloon is mounted, thereby inflating the balloon. A one-way valve inside the shaft prevents the air from escaping from the balloon. Forcibly separating the bead from the shaft is accomplished by telescoping the shaft into the sleeve, which causes the end of the sleeve to ram the bead and thereby urge the bead up to and past the end of the shaft. Upon separation of the bead from the shaft, the escaping air from the balloon causes the balloon to fly away.

Of special significance is the fact that, due to the indentations in the shaft, the inside rim of a bead mounted on the shaft will only come into contact with the shaft at certain points and not at others. In other words, the bead will essentially conform to the outermost circumference of the shaft, thus stretching over and across the indentations in the shaft. This arrangement increases the ramming efficiency of the sleeve by providing more effective points of contact between the end of the sleeve and the bead. More specifically, the projections on the interior surface of the sleeve extend into the indentations in the shaft to points below the outermost surface of the shaft on which the inside rim of the bead rests. Thus, the sleeve projections are able to prevent the bead from becoming interposed or jammed between the shaft and the sleeve.

To permit a balloon to be positioned away from a child's face and eyes while the child inflates the balloon, the shaft is bent to form an angle such that the balloon mounting end of the shaft is approximately perpendicular to the end of the shaft into which air may be blown, which may be referred to as the mouthpiece end. The mouthpiece end of the shaft protrudes through a slot in the sleeve. This permits the mechanism to be held such that the balloon is pointing downward and the mouthpiece end of the shaft is in an approximately horizontal position.

For ease of operation, a flange is attached to the mouthpiece end of the shaft, which flange is approximately perpendicular to the sleeve. The flange may be formed so as to substantially encircle the sleeve, if desired. In addition, the sleeve has a base plate, perpendicular to the sleeve at the end of the sleeve opposite the end where the shaft protrudes, which base plate permits the mechanism to stand upright. Thus, to eject a balloon by telescoping the shaft and the sleeve, a child may place the mechanism on a surface and press downward on the flange. Alternately, the child may hold the mechanism aloft and press the flange and base plate together to telescope the shaft and the sleeve.

To protect a child's face and eyes in the event a balloon bursts while the child is inflating the balloon, the base plate on the end of the sleeve is of sufficient dimensions to provide a protective barrier while the mechanism is being held with the balloon pointing downward. In other words, pointing the balloon downward interposes the base plate between the child's face and the balloon while the child is blowing air into the mouthpiece end of the shaft.

A compression spring is located between the flange and the base plate of the mechanism which serves to push the flange and base plate in opposite directions. Since the flange is attached to the shaft, this causes the balloon mounting end of the shaft to protrude out of the sleeve. The distance to which the shaft may protrude is limited by the mouthpiece end of the shaft coming into contact with the top of the slot in the sleeve. When the shaft and the sleeve are telescoped to eject a balloon, the spring is compressed between the base plate and the flange. Following ejection, the spring restores the mechanism to an extended position, with the balloon mounting end of the shaft again protruding out of the sleeve.

The toy balloon inflation and ejection device of this invention permits inexpensive manufacturing and assembly since the device contains only four parts: the shaft; the sleeve; the one-way valve; and the spring.

In one variation of the invention, a bevel is included at the top of the balloon mounting end of the shaft to provide a surface against which the balloon neck (i.e., the portion of the balloon adjacent the bead) will rest, thereby forming a seal and preventing air from escaping through the indentations in the shaft. A comparable objective is achieved in another variation of the invention wherein spring-action stops are located in the indentations in the shaft, which stops extend outwardly to block air passage in the indentations. When the shaft and the sleeve are telescoped, the stops are pushed inwardly to a recessed position by the projections on the sleeve.

A docking station may be provided for holding a plurality of toy balloon inflation and ejection devices according to the present invention, so as to form a multiple balloon launching toy. Each inflation and ejection device would be attached either permanently or removably in a separate location on the docking station, thereby permitting many balloons to be launched in rapid succession. The docking station may be formed so as to permit independent aiming of each of the attached inflation and ejection devices, and also may be outfitted with wheels to provide a mobile launcher.

Among the objects and advantages of the present invention is to provide an educational toy that simulates a rocket being launched that would be fun to play with, and that demonstrates a basic law of physics applicable to rockets, the jet airplane, and the like. With the foregoing and other objects, advantages, and features of the invention that will become hereinafter apparent, the nature of the invention may be more clearly understood by reference to the following detailed description of the invention, the appended claims, and to the several views illustrated in the drawings.

BRIEF DESCRIPTION OF THE DRAWING FIGURES

Figure 5:
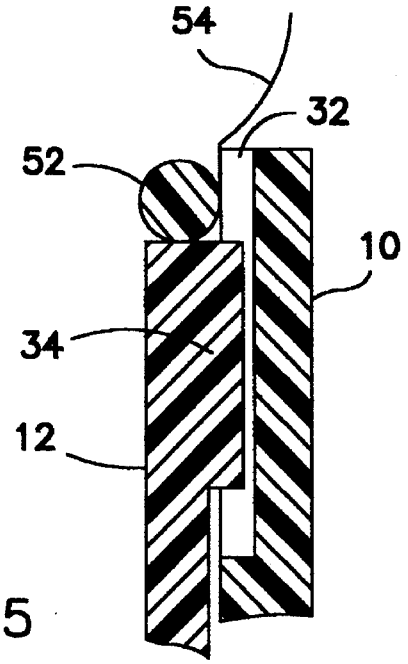
FIG. 5 is an enlarged fragmentary sectional view of the toy balloon inflation and ejection device taken along line 5—5 of FIG. 1, with the addition of the bead and a portion of the neck of a balloon prior to launch, and illustrates a ridge projecting from the inside surface of the sleeve underneath and past the bead of the balloon into an indented groove in the shaft.
Figure 7:
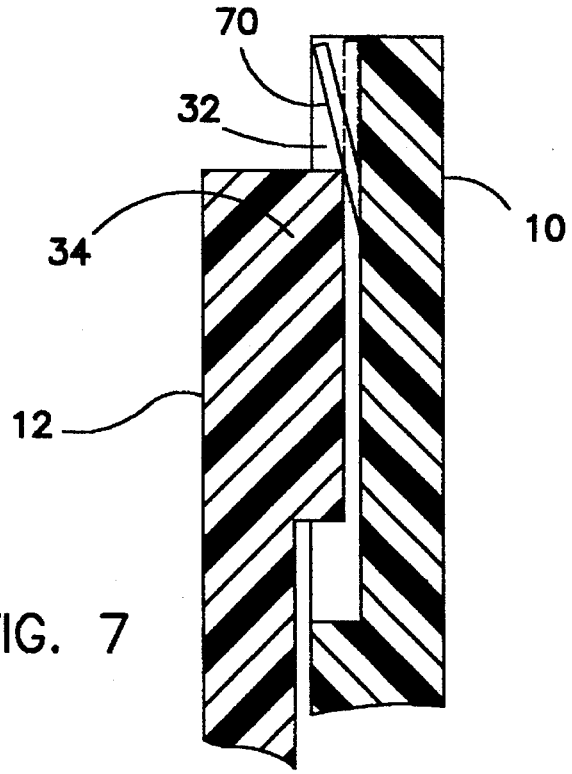
Figure 8:
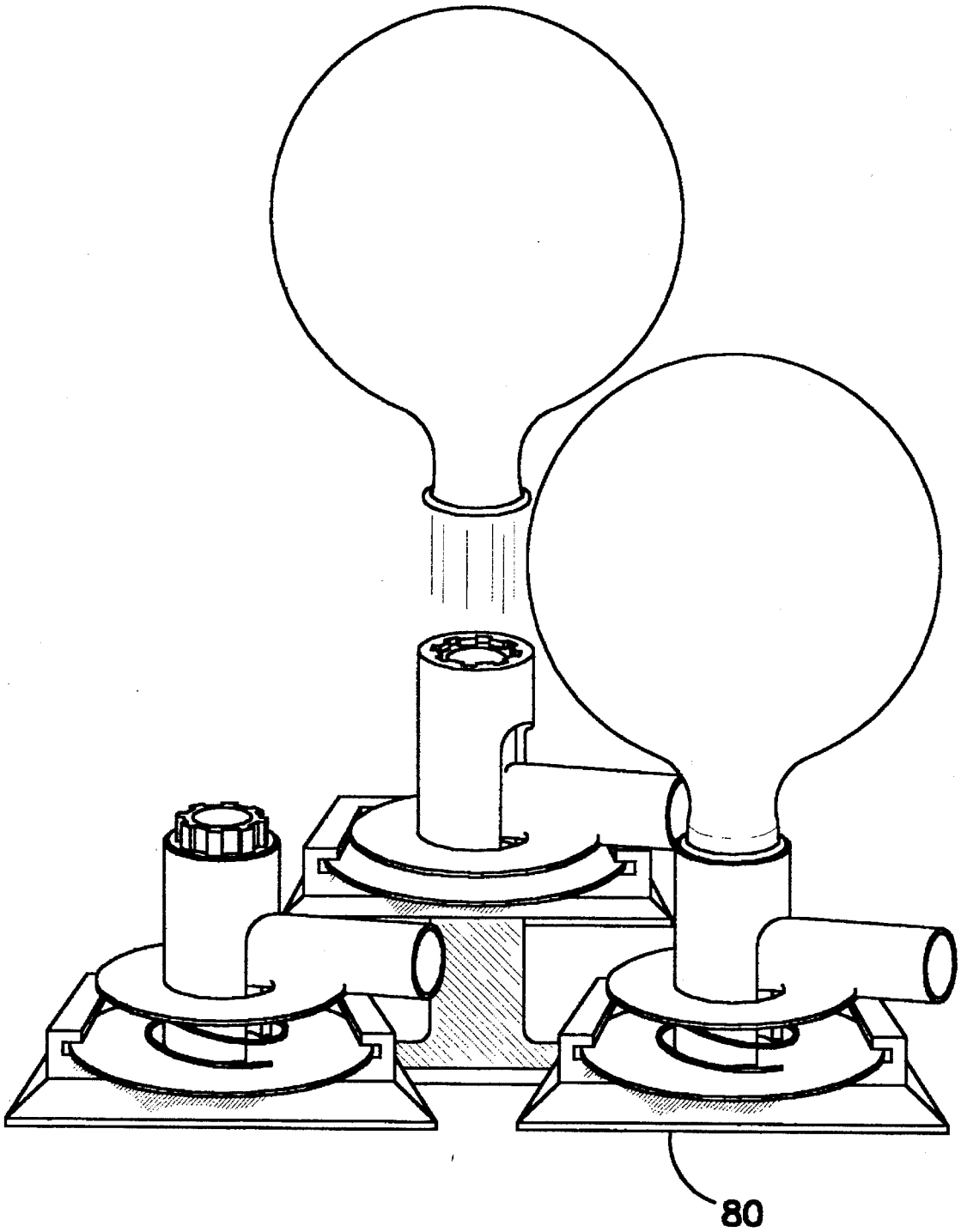

FIG. 7 is an enlarged fragmentary sectional view similar to FIG. 5, but illustrates an alternate embodiment of this invention, showing a movable spring-action stop located in a groove of the shaft, illustrating the stop in extended (solid line) and recessed (phantom line) positions; and, FIG. 8 is a perspective view of a docking station for multiple toy balloon inflation and ejection devices according to this invention.

| Reference Numerals in Drawing FIGS. |
|---|
| 10 shaft |
| 12 ejector sleeve |
| 14 shaft flange |
| 16 shaft mouthpiece |
| 18 cutout |
| 20 base plate |
| 22 compression spring |
| 24 valve grate |
| 26 valve flap |
| 28 slot |
| 30 ramming surface |
| 32 shaft groove |
| 34 ejector sleeve ridge |
| 50 balloon |
| 52 balloon bead |
| 54 ballon neck |

-continued

| Reference Numerals in Drawing FIGS. |
|---|
| 60 bevel |
| 70 shaft spring stop |
| 80 docking station |

DETAILED DESCRIPTION OF THE INVENTION

Figure 1:
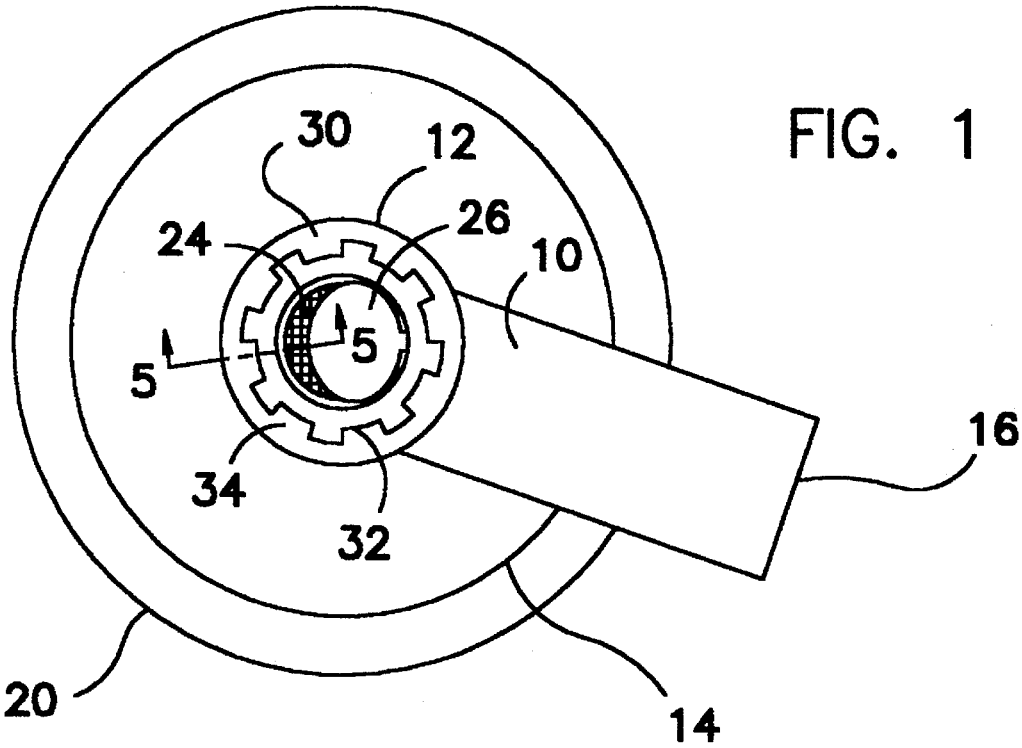
FIG. 1 is a top view of a toy balloon inflation and ejection device according to the present invention.
Figure 2:
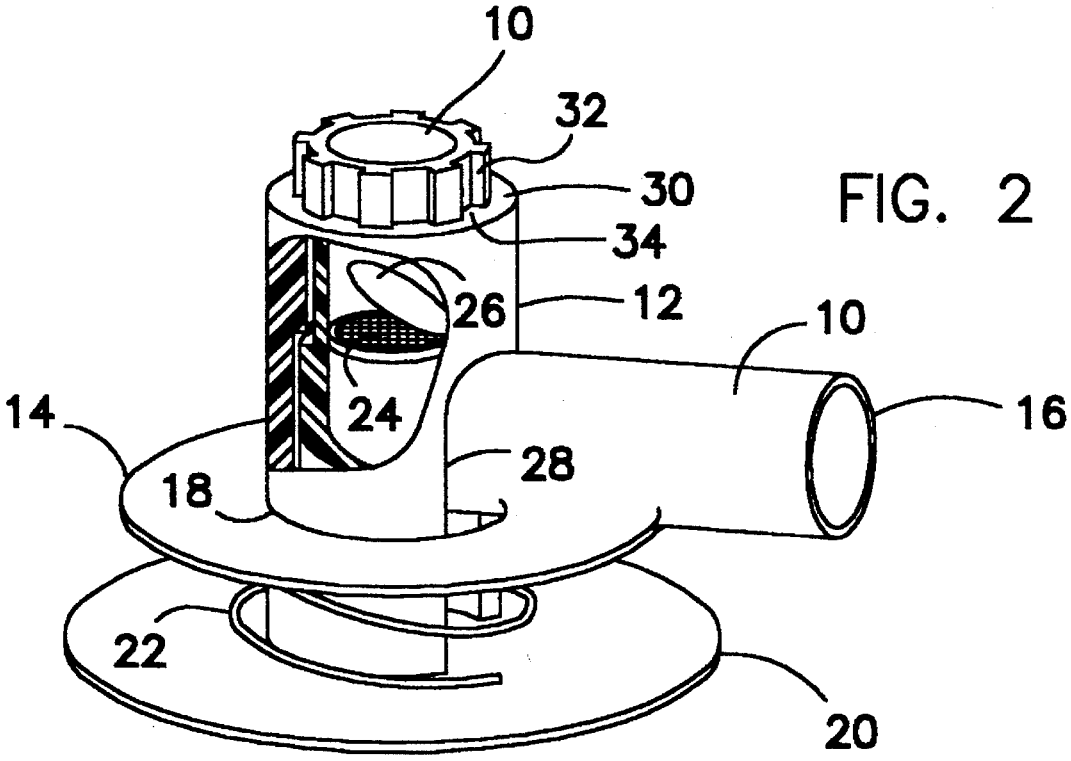
FIG. 2 is a perspective side view of the toy balloon inflation and ejection device partially in section view.

Referring now in detail to the drawings wherein like parts are designated by like reference numerals throughout, FIGS. 1 and 2 illustrate a toy balloon inflation and ejection device according to the present invention viewed from the top and side respectively. The present embodiment of the invention is described in terms of a hollow elongated shaft 10, with a right-angle bend approximately in the middle, such that one segment of the shaft 10 is vertical and the other segment is horizontal. Other angles and locations of the bend may be substituted. The vertical segment of the shaft 10 is concentrically and slidably located within a close-fitting ejector sleeve 12. The horizontal segment of the shaft 10 extends laterally through a slot 28 in the sleeve 12 and forms a shaft mouthpiece 16. The slot 28 extends longitudinally from the bottom end of the sleeve 12 a portion of the length of the sleeve 12.

Extending laterally from the underside of the mouthpiece 16 is a flat shaft flange 14 which encircles the sleeve 12. The flange 14 has a cutout 18 through which the sleeve 12 passes. The shaft 10, mouthpiece 16, and flange 14 comprise one piece, slidably mounted within and without the sleeve 12.

In this preferred embodiment, the flange 14 is flat and round. Alternate shapes and equivalent structures may be substituted; including structures that do not encircle the sleeve 12.

The sleeve 12 terminates at its bottom end in a base plate 20 that extends laterally from the sleeve 12 in parallel with the flange 14. Surrounding the sleeve 12 and situated between the base plate 20 and the flange 14 is a compression spring 22 or the equivalent.

The spring 22 exerts upward force from the base plate 20 against the underside of the flange 14 so as to elevate the flange 14, mouthpiece 16, and shaft 10. Such elevation is intended to cause the top of the vertical segment of the shaft 10 to protrude out of the top of the sleeve 12, and is stopped by the top of the mouthpiece 16 coming into contact with the top of the slot 28. Alternatively, the shaft 10 and its associated parts may be elevated manually and held in position by a spring-clip, movable detent, or the like.

The exterior surface of the vertical segment of the shaft 10 has indentations extending longitudinally from the top end of the shaft 10 a portion of the length of the shaft 10. Accordingly, there is illustrated a series of shaft grooves 32. The interior surface, or bore, of the sleeve 12 has projections extending longitudinally from its top end a portion of its length; and, accordingly, there is illustrated a series of inwardly projecting ejector sleeve ridges 34. The ridges 34 inversely match the grooves 32 in shape, size, and location such that there is minimal space or gapping in between, but also such that the shaft 10 and the sleeve 12 may slide easily in relation to one another. The planar top end of the sleeve 12 forms a ramming surface 30.

In the embodiment presently disclosed, the grooves 32 and the ridges 34 are trilateral and equidistant. Equivalent structures may be substituted, including various other shapes and spacing. The shaft 10 and the sleeve 12 may each be generally cylindrical, or may be constructed in various other shapes; including structures having an exterior surface that differs in shape from its interior surface, provided that the indentations in the exterior surface of the shaft 10 inversely match the projections on the interior surface of the sleeve 12 over the respective lengths where they slide in close relation to one another.

The shaft 10 contains a perforated valve grate 24 and a flexible, air-impermeable valve flap 26. The grate 24 and flap 26 are operatively coupled to form a one-way valve such that air may flow freely in through the mouthpiece 16 and out through the top of the vertical segment of the shaft 10, but air flowing in the opposite direction would cause the flap 26 to halt the flow by forming a seal over the grate 24. Equivalent one-way valve structures may be substituted.

Figure 3:
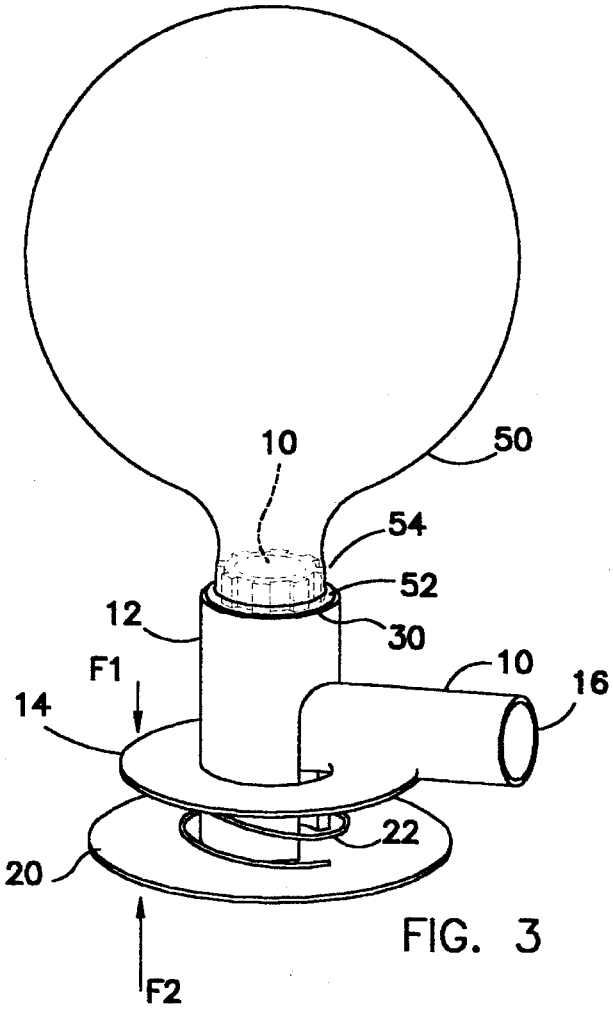
FIG. 3 is a perspective side view of the toy balloon inflation and ejection device showing an inflated balloon releasably affixed, in pre-launch position.

Turning now to FIG. 3, the launcher is shown with a balloon 50 having been releasably affixed and inflated. Affixing the balloon 50 is accomplished by pulling the balloon bead 52 over the top end of the shaft 10, which represents the balloon mounting end of the shaft 10. This action may result in a portion of the balloon neck 54 also being pulled over the top end of the shaft 10. The bead 52 frictionally adheres to the top end of the shaft 10 above the ramming surface 30 of the sleeve 12. Any balloon having a bead that is smaller in diameter than the diameter of the top of the shaft 10 may thus be affixed.

Inflation is accomplished by blowing in through the mouthpiece 16. Prior to inflation, however, if the invention is turned upside-down, as is intended, i.e., rotated 180-degrees around the axis represented by the mouthpiece 16, then an uninflated balloon having been affixed to the shaft 10 will hang downward below the invention. Such positioning allows the base plate 20 to provide a protective barrier during inflation that shields a child's face and eyes against balloon fragments in the event the balloon bursts during inflation.

In the embodiment presently disclosed, the base plate 20 is flat and round. Equivalent structures may be substituted, including various other shapes and sizes.

To launch a balloon once it has been inflated, the invention may be placed on a surface, such as a table, and a pressure force F1 applied to the top of the flange 14, as by manually pressing downward. This action causes the shaft 10 and the sleeve 12 to telescope; which, in the process, compresses the spring 22 between the flange 14 and the base plate 20. As the shaft 10 travels downward, the bead 52 is prevented from also traveling downward by the stationary ramming surface 30 of the sleeve 12. The continuing downward motion of the shaft 10 in relation to the ramming surface 30 thus forcibly deprives the bead 52 of more and more surface space on the shaft 10 upon which to adhere. Ultimately, the top end of the shaft 10 passes the level of the ramming surface 30, thus fully depriving the bead 52 of all surface space on the shaft 10 upon which to adhere. Air pressure within the balloon 50 then causes it to fly away.

Figure 4:
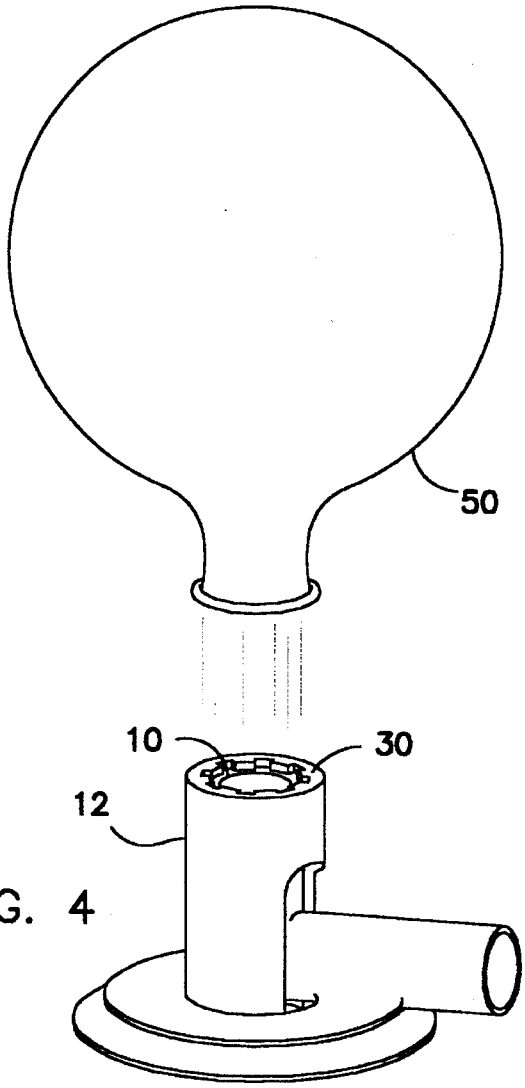
FIG. 4 is a perspective side view of the toy balloon inflation and ejection device in telescoped, post-launch position, showing a balloon in flight.

This is further illustrated in FIG. 4, which shows the invention in telescoped, post-launch position with the balloon 50 flying away. Note that the relative lengths of the shaft 10 and the sleeve 12 are such that the top end of the shaft 10 may travel below the ramming surface 30. Although the ejection action of the launcher is typically completed at or before the moment the top end of the shaft 10 becomes level with the ramming surface 30, the additional downward travel of the shaft 10 ensures efficient ejection of the balloon.

The compression of the spring 22 during the above described launching action does not play a role in the ejection of the balloon. Following ejection of the balloon, however, when the child releases pressure on the flange 14, the spring 22 decompresses; thereby restoring the launcher to a fully extended state, ready to be used again.

In an alternative method of operation, once the balloon has been inflated, the invention may be manually held aloft and a pressure force F2 (FIG. 3), applied to the underside of the base plate 20, as by holding the flange 14 and the base plate 20 between the fingers and the thumbs and pressing on the underside of the base plate 20 with the thumbs. In this method of operation, the invention may be held in a vertical position, a horizontal position, or at any desired angle of rotation.

To more clearly illustrate the ejection principle of the launcher, FIG. 5 shows an enlarged fragmentary sectional view of a portion of the upper ends of the shaft 10 and the sleeve 12 respectively. A portion of the bead 52 and the neck 54 of the balloon 50 (FIGS. 3, 4), are also shown as having been affixed to the top of the shaft 10. Note that the ridge 34 which is positioned in the groove 32 extends in a horizontal direction underneath the bead 52 past the point where the bead 52 rests on the shaft 10. Due to the widths and the spacing of the grooves 32 and the natural elasticity of latex balloons, the bead 52 conforms relatively to the outer-most dimensions of the shaft 10; i.e., the bead 52 stretches over and across the grooves 32 without pressing into the grooves 32 more than a minimal amount. When the launcher is telescoped to forcibly eject a balloon, since the ridges 34 extend into the grooves 32 underneath and past the bead 52, the bead 52 is prevented from being pinched between the shaft 10 and the sleeve 12. This ensures the efficient ejection of balloons of a wide range of sizes, including smaller balloons that adhere tightly to the shaft 10.

An ejection effect comparable to that of the present invention may conceivably be achieved using a conventional shaft and sleeve apparatus lacking ridges and grooves. However, in order to ensure consistent and efficient operation, such an apparatus would need to be manufactured within extremely close tolerances to ensure an extremely tight, yet slidable fit between the shaft and sleeve. Manufacturing such an apparatus would be considerably more expensive than the present invention.

In further explanation, although the bead on the neck of a balloon is typically formed as a thick ring of latex, the bead is sufficiently soft and pliable that the bead can be pinched between a conventional shaft and sleeve when they are telescoped, even if the shaft and sleeve are relatively close fitting. Such pinching often results in the balloon being only partially ejected; i,e., a portion of the bead remains stuck between the shaft and sleeve such that the balloon cannot fly away, resulting in the balloon exhausting its air in place.

The present invention overcomes the pinching problem through the combination of: (a) providing indentations where a balloon bead does not come into contact with the support structure (i.e., the grooves 32 in the shaft 10); and, (b) increasing the operative surface area of the ejection structure (i.e., the ramming surface 30 of the sleeve 12), by extending it into the indentations to points below the outermost surface area of the support structure on which the bead rests (i.e., the projections, represented by the ridges 34). The adhesion of the bead that still occurs where the bead does come into contact with the shaft 10 is easily and smoothly overcome by the increased ramming efficiency of the ridges 34.

Figure 6:
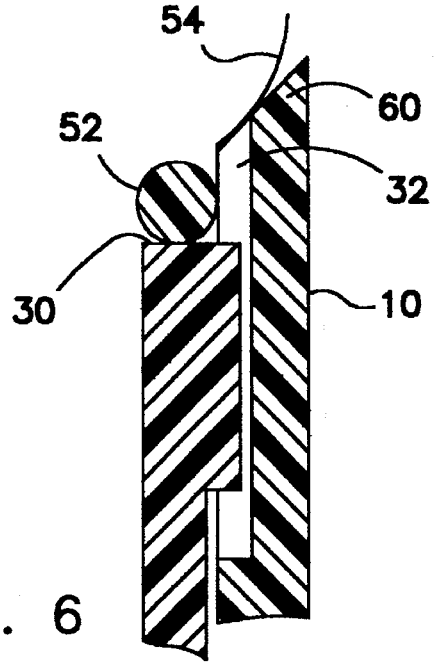
FIG. 6 is an enlarged fragmentary sectional view similar to FIG. 5, but illustrates an alternate embodiment of this invention that has a bevel at the top of the shaft.

Turning now to FIG. 6 which is comparable to the view in FIG. 5, but illustrates an alternate embodiment of the launcher wherein a bevel 60 has been added to the top end of the shaft 10. The bevel 60 extends around the entire top rim of the shaft 10. As shown, the angle of the bevel 60 is comparable to that established by the natural contraction of the balloon neck 54 above where it is held open by the shaft 10. The purpose of the bevel 60 is to provide a uniform surface against which the contracting neck 54 will rest, at a level above the top ends of the grooves 32. The contracting neck 54 forms a seal against the bevel 60 which reduces the amount of air that may escape from an inflated balloon via the grooves 32. The bevel 60 is not needed if, in use, the bead 52 is affixed properly on the shaft 10 such that it either contacts or is in close proximity to the ramming surface 30.

While the foregoing description of the bevel 60 illustrates a preferred embodiment, suitable equivalents capable of providing a surface against which the contracting neck of a balloon may rest so as to provide a seal against air escaping through the grooves 34 are acceptable alternatives.

FIG. 7, which is also comparable to the view in FIG. 5, illustrates another alternate embodiment intended to reduce the amount of air that may flow through the grooves 32 when a balloon bead is not properly affixed. A spring stop 70 located within the groove 32 and attached at its bottom end is represented in its normal, extended position in solid line form. The top end of the stop 70 rests at or near the top outer edge of the groove 32 so as to block the passage of air through the groove 32. Upon the telescoping of the shaft 10 and the sleeve 12, the ridge 34 comes into contact with the stop 70 and forces it to temporarily bend out of the way into a recessed position, which is represented in broken line form. Fully extending the launcher once again permits the stop 70 to return to its normal position. In this embodiment, each groove 32 has a stop 70.

As with the previous embodiment, the foregoing description of the stop 70 is merely illustrative of a preferred embodiment: suitable equivalents capable of blocking the passage of air through the groove 32 without interfering with movement of the ridge 34 are acceptable alternatives. Such alternatives may include movable stops that are not physically attached to the groove 32 or to any portion of the shaft 10.

Turning now to FIG. 8 there is illustrated a plurality of launchers according to the present invention having been combined on a single docking station 80. The docking station 80 permits the launching of a plurality of balloons in rapid succession, simulating the launching of multiple rockets. The individual launchers may be either permanently affixed to the docking station 80, or may be temporarily held in position on the docking station 80 by any number of methods, including spring clips or the like. Alternate and equivalent structures may be substituted, including: structures that facilitate the movement of individual launchers into different lateral positions or elevations relative to one another; structures that permit individual launchers to aim in different directions; and, mobile structures having wheels or other means for simulating a mobile rocket launcher.

In general, all of the parts of the present invention excluding the spring 22 and valve flap 26 may be made of molded plastic, or wood, or other rigid and semi-rigid materials. The spring 22 may be made of metal or plastic, or other materials which may be used to achieve a spring action; and the valve flap 26 may be made from a variety of materials, including plastic, leather, coated paper, and the like.

Although certain presently preferred embodiments of the invention have been described herein, it will be apparent to those skilled in the art to which the invention pertains that variations and modifications of the described embodiments may be made without departing from the spirit and scope of the invention. Accordingly, it is intended that the invention be limited only to the extent required by the appended claims and the applicable rules of law.

What is claimed is:

1. A toy device for inflating and ejecting a balloon having a bead, comprising:

(a) support means having two ends and a surface area on one of said ends to which the balloon will frictionally adhere when the bead is stretched open and pulled over, said surface area having intermittent indentations where the bead will not come into contact with said support means;

(b) inflation means connected to said support means to permit air to be blown into the balloon and maintained therein; and (c) ejection means having intermittent projections in close proximity to said support means surface area in alignment with the intermittent indentations in said surface area, each of said projections having a surface area disposed perpendicular to said support means surface area, and said ejection means being movable so as to bring said projection surface areas into contact with the bead and to urge the bead off said support means.

2. The device according to claim 1, further including a shield means whereby the face and eyes of a child may be protected against balloon fragments in the event a balloon bursts during inflation.

3. The device according to claim 1, further including a spring means operatively coupled to said ejection means, whereby the movement of said ejection means so as to bring said projection surface areas into contact with the bead and to urge the bead off said support means may be reversed after the bead is urged off said support means.

4. The device according to claim 1, wherein said ejection means projections are elongated so as to be partially disposed within the indentations in said support means surface area.

5. The device according to claim 1, wherein said support means includes a hollow elongated shaft having two ends and a surface area, one of said ends of the elongated shaft having intermittent indentations in said surface area, representing a balloon mounting end, said shaft also having an interior bore of sufficient breadth so as to permit air to be blown into a balloon mounted on said balloon mounting end from the other end of said shaft, said other end of the elongated shaft representing a mouthpiece end.

6. The device according to claim 5, said shaft including a one-way valve disposed within said bore, and wherein said inflation means comprises the combination of said bore and said one-way valve.

7. The device according to claim 5, wherein said ejection means includes a sleeve having an interior and an exterior surface, said sleeve substantially encircling said shaft in slidable and concentric relationship therewith, and said projections protrude from said interior surface of said sleeve, whereby said shaft may be telescoped into said sleeve.

8. The device according to claim 7, wherein one end of said sleeve is substantially planar in perpendicular relationship with said shaft so as to permit contact between said projections and the bead to occur uniformly, said planar end representing a ramming end.

9. The device according to claim 7, wherein the indentations in said shaft comprise longitudinal grooves, and said sleeve projections comprise longitudinal ridges inversely proportional to said grooves.

10. The device according to claim 7, wherein said shaft is bent to form an angle, and said mouthpiece end protrudes laterally through a slot in said sleeve, whereby the balloon on said balloon mounting end may be pointed downward and away from a child's face while air is blown into said mouthpiece end.

11. The device according to claim 7, further including a flange attached to said shaft mouthpiece end in substantially perpendicular relationship to said balloon mounting end, whereby said device may be conveniently held and operated.

12. The device according to claim 11, further including a base plate laterally extending from said sleeve, so as to permit said device to stand upright, whereby said device may be operated conveniently by the downward application of force against said flange.

13. The device according to claim 12, wherein said base plate is of sufficient dimensions so as to comprise said shield means, whereby pointing the balloon downward during inflation interposes said base plate between the balloon and a child's face and eyes.

14. The device according to claim 12, wherein said spring means comprises a compression spring disposed between said flange and said base plate.

* * * * *